United States Patent [19]

Devrient

[11] Patent Number: 4,629,630

[45] Date of Patent: Dec. 16, 1986

[54] CHECK PAPER THAT IS PROTECTED AGAINST FORGERY AND TAMPERING

[75] Inventor: Ludwig Devrient, Vaterstetten, Fed. Rep. of Germany

[73] Assignee: GAO Gesellschaft Fuer Automation und Organisation mbH, Munich, Fed. Rep. of Germany

[21] Appl. No.: 605,107

[22] Filed: Apr. 30, 1984

Related U.S. Application Data

[60] Division of Ser. No. 376,681, May 10, 1982, Pat. No. 4,496,961, which is a continuation of Ser. No. 217,422, Dec. 17, 1980, abandoned.

[30] Foreign Application Priority Data

Dec. 20, 1979 [DE] Fed. Rep. of Germany ..... 2951486

[51] Int. Cl.[4] ..... B44F 1/12

[52] U.S. Cl. ..... 427/7; 162/124; 162/126; 162/127; 162/162; 427/150; 427/151; 427/421

[58] Field of Search ..... 162/126, 127, 140, 162, 162/124; 282/27.5; 427/150, 151, 7, 421; 428/199, 201, 211, 535, 537, 915, 916, 914, 411, 321.3, 321.1, 320.2, 321.5, 120; 346/135.1

[56] References Cited

U.S. PATENT DOCUMENTS

| | | | |
|---|---|---|---|
| 54,835 | 5/1866 | Jones | 427/7 |
| 2,288,147 | 6/1942 | Smith | 427/1 |
| 3,558,341 | 1/1971 | Phillips | 427/150 |
| 3,953,642 | 4/1976 | Forbess et al. | 428/204 |
| 4,037,007 | 7/1977 | Wood | 427/7 |
| 4,037,077 | 7/1977 | Wood | 428/199 |
| 4,121,961 | 10/1978 | Brunette et al. | 427/7 |
| 4,143,891 | 3/1979 | Neubauer | 427/7 |
| 4,170,482 | 10/1979 | Mansukhani | 427/421 |
| 4,247,318 | 1/1981 | Lee et al. | 156/163 |
| 4,360,548 | 11/1982 | Skees et al. | 427/7 |

FOREIGN PATENT DOCUMENTS

| | | |
|---|---|---|
| 1041599 | 9/1966 | United Kingdom . |
| 1042596 | 9/1966 | United Kingdom . |
| 1197406 | 7/1970 | United Kingdom . |

*Primary Examiner*—John D. Smith
*Assistant Examiner*—Janyce H. Bell
*Attorney, Agent, or Firm*—Robert J. Koch

[57] ABSTRACT

A check paper is being described which is protected against falsifications and forgeries. Crushable micro capsules are being embedded in check paper which contain on one hand a leuco ink and on the other hand a color acceptor. The color acceptor can also be stored in the body of the paper without the use of micro capsules. The leuco ink and the color acceptor react together under color development or color changes if the micro capsules burst through imprinting or other local pressure application to the paper surface. Thus, a character written on the paper surface becomes visible within the body of the paper and cannot be forged anymore.

18 Claims, 9 Drawing Figures

CHECK PAPER THAT IS PROTECTED AGAINST FORGERY AND TAMPERING

Figure 1:
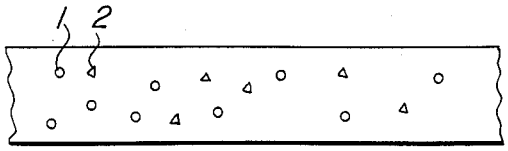

This is a division of application Ser. No. 376,681, filed May 10, 1982, now U.S. Pat. No. 4,496,961 which in turn is a continuation of Ser. No. 172,422, filed Dec. 17, 1980, now abandoned.

BACKGROUND OF THE INVENTION

The invention concerns a check paper, that is forgery- and tamper proof, which is provided with crushable micro capsules, which contain a leuco ink, and with a color acceptor which reacts with the leuco ink to color development- or change. Furthermore, the invention concerns a method for the production of such a check paper.

Commercial dealings handle assets and claims to such assets with documents written or printed on paper. For example, such documents can be bank notes, checks or stocks. In these, as with all other cases where printed or written documents take on an importance, (documents, passports, travel- or airline tickets of high value) one has to make sure that the content of such documents cannot be altered at all or only with great difficulty. This is generally obtained by making it so, that manipulations on such documents leave visible traces which show the attempt to alter. For this purpose, one uses also reagents which are added to the paper. Such reagents respond very well to many tampering attempts with chemical means. However, frequently a protection against alteration attempts through mechanical erasing, is lacking.

It is known how to protect valuable prints against mechanical erasing attempts by means of complicated background design, whereby these background designs are formed in such a way that they are irreversibly changed or destroyed by erasing attempts. Thus, manipulation attempts, are easy to recognize. However, such security measures,-especially in the case of automatically processed valuable prints as checks and such, which are areas in which manipulations are usually tried, (for instance OCR-line)- can only be used to a limited extent since in many cases such background designs destroy the readability of the data that has to be automatically processed.

One can also secure paper against mechanical erasing by combining it from three differently colored layers. If one erases the whiter, outer layer of such a paper the result would be that the color of the layer below turns clearer which indicates an erasion attempt. However, such paper has to be manufactured on machines especially made for this and with a relatively high effort. The fact that the coloring of the layers and the resulting opaqueness makes it very difficult to apply a watermark it might even be useless if also considered a disadvantage.

It is also known to protect a paper against erasing by producing it with the least possible density. Thus, such a paper consists of a rather loose fiber bond where erasion attempts create a large destruction. This way the erasion attempt is visible, however, such a loosely processed paper has generally not strength factors required for most application purposes.

Another possibility for the protection of security papers against mechanical erasure is specified in the German patent application No. 16 596.

According to it, a check paper for checks and similar uses is already known, it consists of two glued together paper layers and has a color print at the inner surfaces. Mechanical erasion attempts wears on the corresponding paper layer and makes it thinner which emphasizes the lines of the inner print and shows the manipulation. Since the inner print is applied with sensitive aniline colors which run when erasing liquids are applied the check paper is thus also protected against chemical erasing. However, paper according to this invention does not meet the requirements needed for check paper nowadays. Glued together paper can be split in its layers and is therefore easily falsified and tampered with.

The use of micro capsules for the protection of security papers and passports has been specified in the German laid-open application No. 23 23 076: For this, the micro capsules have to be filled with liquid crystals which show a color change at a temperature compatible to the security paper. Hereby, these capsules have only the function of a validity characteristic, their aid shall help differentiate between falsification and the real security papers. For this, the check paper is subjected to a corresponding temperature whereby the usually invisible micro capsules become visible through their color change.

In this test, the micro capsules are not crushed, their casings can therefore be very stable. The known check paper which was treated with the micro capsules protects however in no way against mechanical erasion attempts and even as validity characteristic these micro capsules are only of a slight value, because the color change compared to the common requirements is too slow and the obtainable color contrasts are not sufficient.

It is not new to protect a security paper or check paper by applying on its surface micro-enclosed leuco inks as it is known from the technology of the copying papers. The application takes place either holohedral by staining or with a suitable printing machine with very low application pressure. If one erases at the thus protected locations, the mechanical pressure destroys the structure of the micro capsule and the color emerges. The reaction with certain color acceptors results in a visible coloring which proves the erasion attempt.

Securing check paper in this manner is specified for instance in the German patent application No. 26 000 781. Accordingly, entrance tickets, airline tickets or bus tickets are provided with a coating which consists of a spray varnish and imbedded micro capsules with leuco ink. This coating covers only one part of the surface of the check paper and has in addition the shape of a design which is preferably made of stripes or wave lines. The design is located at a point which is intended for the stamping or the writing on the check paper and does not cover it completely. During the labeling, and according to the design used, the micro capsules effected by the writing are destroyed, the outflowing leuco ink react with the color acceptor present in the paper structure and becomes visible because of the subsequent color reaction. A subsequent change of the imprinted information is only possible if the layer is completely worn down.

The known paper does not meet all requirements which are needed for a check paper which is protected against mechanical erasing. The micro capsules are exclusively on the surface of the paper and thus almost in the same plane as the printed information. Therefore, falsifications are not made difficult enough. Because, if one erases only a sufficiently thick layer of the surface one removes simultaneously the information and the information protecting, through the micro capsules caused image of this formation in the surface coating, still the paper remains at this point thick enough in order to apply subsequently a new falsified information. If one should succeed with chemical or mechanical means to dissolve the surface coating one removes simultaneously with it the information printed above without affecting the actual paper mass. Since the man skilled in the art is familiar with the technology and application of micro capsules with leuco inks, subsequently a new coating can be applied and the falsified information can be written on it. For the same reason, this known securing does not represent a protection against total falsifications. Another disadvantage has also to do with the arrangement of the micro capsules on the surface of the paper. Herewith, the coating lies not only in the area of the largest mechanical stress but it is also subjected to influences like surface damage, scratches etc. All these effects cause unintended discolorings of the check paper through the stresses it is subjected to.

The purpose of the invention is the production of a paper that is effectively protected by micro capsules against erasing. Hereby the presence of the micro capsules shall guarantee at the same time the validity of the check paper, that is, exclude total falsifications and enable the application of additional authenticity characteristics like the water mark for example. Furthermore, the check paper shall be made in a way that the stress occurring during circulation does not unintentionally discolor it.

According to invention this objective is met by the fact that the micro capsules and the color acceptor are present within the paper mass.

Advantageous further developments of the check paper according to invention are subject of the sub claims.

The manufacturing of the check paper according to invention takes place in the known prior art on a paper machine, however before the development of the sheet one adds micro enclosed leuco inks as well as reaction partners, that is, color acceptors to the paper material. If necessary the color acceptor can also be present in micro enclosed form. The condition for this manufacturing procedure is the coordination of wall thickness and strength of the micro capsules with the production devices which mechanically stress the paper so that during the production of the paper (including the various pressing- and drying processes) the micro capsules are not destroyed.

According to a preferred method, the paper is produced on a double-filter machine in such a way that the micro enclosed leuco ink is embedded in a web taken by the first sieve while the color acceptor is located in an additional web taken by a second sieve. These webs are joined and couched together before drying.

The check paper, produced according to the mentioned preferred manufacturing procedure has special advantages. By writing on the paper, the micro capsules, which are located under the letters are destroyed, the color reaction takes place mainly at the boundaries which are provided by the second manufacturing process. Only in this area are both reaction partners- and of those at least one micro-enclosed- existent in close proximity. Therefore, writing causes an image of the applied information in an internal area of the document. Naturally, this cannot be erased without destroying the paper structure visibly and lastingly. Since the application of the micro capsules in the specified manner requires the whole operating effort as well as the special know-how of the check paper production, the color reaction in an internal area of the check paper, is a reliable characteristic of its authenticity, similar to the way this is proven by the security thread.

Furthermore, the embedding of the micro capsules into the paper represents at the same time a mechanical protection for the capsules. There are no reaction partners with which the ink can react during an unintentional damage to the capsules in the outer layers near the micro capsules which are naturally subjected to special stress. Even though the capsules, capable to reaction within the check paper are protected relatively well by the paper itself, the rather high pressure affecting them during the writing causes the positive destruction of the micro capsules. If one removes from a security paper according to invention the applied information through mechanical erasing the image in the inner layer remains visible and indicates clearly a possible intent to falsify. Check paper manufactured in the specified manner is imprintable without destroying thereby the micro capsules. The commonly used printing methods, with the exception of the steel intaglio printing method, are perfectly suitable.

The suitable shaping of the relative densities of both paper layers permits it that the color-reaction zone is located more on the front or the back of the sheet. If for example the reaction zone lies mainly on the back of the sheet then the forgery attempt on the front of the sheet will appear to have been successful. Only an inspection of the back of the sheet would reveal the forgery attempt. On the the other hand, placing the reaction layer on the front of the sheet each forgery attempt would be immediately visible.

Figure 1A:
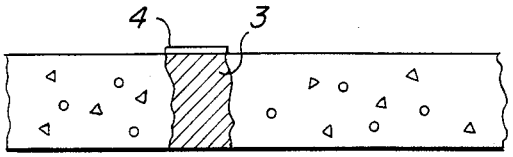
Figure 2:
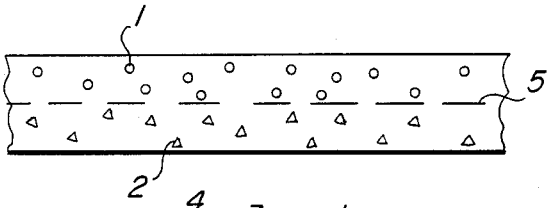
Figure 2A:
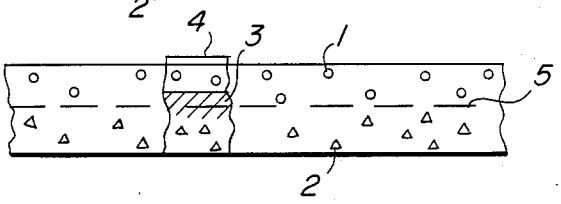
Figure 3:
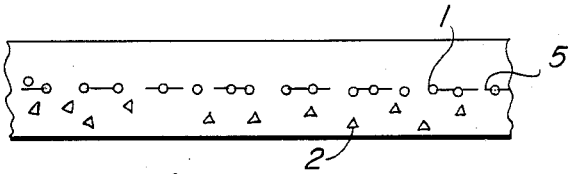
Figure 3A:
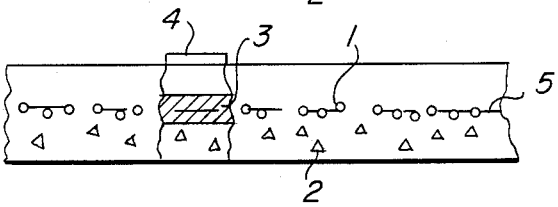
Figure 4:
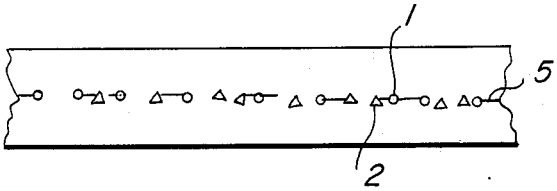
Figure 4A:
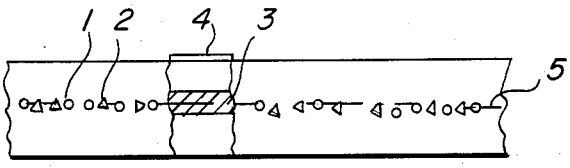
Figure 5:
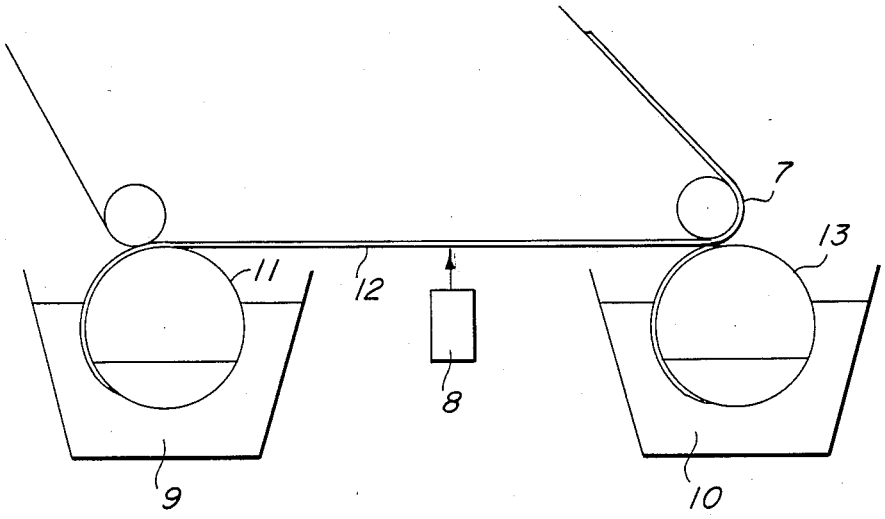

In the following the invention is being explained in detail by means of examples and attached drawings. Shown are:

FIG. 1, a cross section of a check paper according to invention, one layered with an even distribution of micro-enclosed leuco ink and color acceptor in the paper volume before imprinting, FIG. 1*a*, a cross section of a check paper according to invention, one layered, with an even distribution of the leuco ink and color acceptor in the paper volume after imprinting, FIG. 2, a cross section of a check paper according to invention, two layered, with an even distribution of micro-enclosed leuco ink in one partial volume of the check paper and even distribution of the color acceptor in another partial volume before imprinting, FIG. 2*a*, a cross section of a check paper according to invention according to FIG. 2, but after imprinting FIG. 3, a cross section of a check paper according to invention, two layered, with micro-enclosed leuco ink in the area specified by the joining of the two layers and with the color acceptor in a partial volume of the check paper before imprinting, FIG. 3*a*, a cross section of a check paper according to invention and according to FIG. 3, however after imprinting, FIG. 4, a cross section of a check paper according to invention, two layered, with micro-enclosed leuco ink and color acceptor, exclusively in the area specified through the joining of the two layers before imprinting, FIG. 4*a*, a cross section of a check paper according to invention and according to FIG. 4, however after imprinting, FIG. 5 a double-sieve paper machine.

EXAMPLE 1

In the easiest case, one produces from water, 50% pine sulphite cellulose and 50% pine sulphate cellulose (bleached) by grinding in a beater, a fiber mash of 3% material density and a grinding degree of 50 SR. Added to this as filler in the usual way are 5% of titan dioxyde. One adds furthermore 1% of an acid silicate (for instance, Copisil from the Sud-Chemie AG) and a micro-encapsulated leuco ink system.

The micro capsule system is obtained in the known way by dissolving a 10% solution of leuco malachite of aniline green in a substituted naphthalene carbon. Part of this solution is emulsified in three parts of water by adding one part of hide glue. Subsequently, one sets the ph-value to neutral and adds a mixture of formalin and glyoxal in an amount of 3% in relation to the total amount of the mixture. Initially, one waits for reaction at rt and subsequently heats to 50–60 degrees.

Of the micro capsule suspension obtained, 3% are added to the fiber material.

One forms from the material suspension, in the known manner, on a wire sieve a sheet which is subsequently couched and dried. During the couching, one has to make sure that the line pressure is not too high. This means that the sheet has to enter the dry part with increased moisture content.

FIG. 1 shows a check paper, standardized before imprinting and produced in this manner. In all of the paper volume, micro enclosed leuco inks 1, as well as acid pigments 2 as a color acceptor and reaction partner are present as neighbors.

During the imprinting and/or stamping, the micro capsules are crushed under the letter 4, the leuco ink appears and reacts with the acid pigments in the neighborhood. FIG. 1*a* shows schematically the discoloring 3, which subsequently runs through the entire paper volume.

This means, that the writing becomes visible through the whole material onto the back of the sheet. Thus, an erasion attempt would only be successful if it would remove all of the paper mass but leave a hole. Any other erasion attempt leads also to the actuation of the protection and to a large green discoloring of the part where the forgery took place.

EXAMPLE 2

By hand or preferably on a double-sieve machine, (FIG. 5) one builds two parts of paper material 9,10.

One adds the acid silcate to one half and the micro capsule suspension, produced according to example 1, to the other half. Initially, one produces on this sieve 11 a sheet 12 of appr. 30 g/m surface related mass, in the prior art from the paper material that contains the acid silicate. This sheet can be processed further and couched without special restrictions. One produces on a second sieve 13, a sheet of 50% surface related mass from the material which contains the micro capsules 1. Both sheet are joined while moist and couched together. After the drying process one obtains a paper which, with appr. $\frac{3}{8}$ of its density, has a contact zone 5 between the acid silicate and the micro capsules, this is shown schematically in a cross section in FIG. 2.

It is a special advantage of this design of the invention that during the imprinting, the image of the imprinting caused by the color reaction, occurs here only in a determined inner area 5, that the inner area can be shifted to a large extent through the desired selection of the layer density during the manufacturing of the paper and that this inner area cannot be exposed through manipulation like separation. Because of the inaccessibility of the design that developed inside the paper, which cannot be simulated by paper coloring, this design serves in the same way as the security threads and similar embeddings, as a valuable sign of authenticity.

The special selection of the location of the reaction zone in the paper volume permits the choice of putting the security design closer to the imprinted surface or more to the back of the security paper so that it becomes more apparent or less on the front of the paper.

The removal of the design through mechanical erasing is not possible without visible destruction of the paper, the design cannot be altered because of the enclosing and protecting papermass.

EXAMPLE 3

Paper material is being produced on a double-sieve machine from two parts as in example 2. However, contrary to examples 1 and 2, the micro-enclosed leuco color is not being added to the pulp, but injected by means of a suitable device 8 between the two webs (7) before they are joined. Preferably, the micro capsules are hereby suspended in a liquid and blown through jets on the paper web. Similar devices are known as ink-vapor recorders. The spraying-on or blowing of the micro capsules which were dried unsuspended is also possible. The color acceptor and/or reaction partner is being added to one half of the paper material as in example 2.

The check paper thus produced is shown schematically in FIG. 3.

Paper according to this design of the invention is characterized by that the reaction zone is smaller than it is with papers according to example 2.

The increased operational effort in the paper production is being compensated by two advantages which have a special significance for a series of applications. First, this check paper is protected to a very high extent against unintented and disturbing color reactions because the micro capsules are really only in the mentioned area; secondly, it permits only the device 8 under conditions according to the production, to add the micro capsules in the form of designs, like stripes or wave lines to the check paper with such designs has the advantage to be canceled in an especially safe and elegant manner. For this, the check paper is being pulled through two press rolls, hereby all micro capsules are destroyed and the design becomes visible. The visibility of the design is simultaneously an indication to the authenticity of the check paper. Attempts to cancel this cancelation or to hide it by erasing is impossible. The limitation of the security means according to invention, to a partial area is furthermore an effective measure to maintain the esthetic quality of the check paper even under more stress.

EXAMPLE 4

Similar to example 3, check paper is produced on a double-sieve paper machine whereby however, the acid reactionable pigment is not added to one half of the paper material as in example 3, but is injected like the micro capsules through the device 8 between the two layers of the paper.

The paper, produced this way is shown schematically in FIG. 4. The color reaction zone, compared to example 3, has become even smaller, the advantages are the same, they are only more distinctive in appearance. Opposite these advantages is an even increased operational effort in paper production.

Of course this invention is not limited to the previously described examples.

The micro capsules can also be filled with a material which shows only after the reaction with its partner a flourescence emission in the visible area of the spectrum. This characteristic can be used in addition to a visible discoloring, however, it can also be used for securing security paper without further visible discoloring. Suitabel colors and reaction partners are specified in the French patent No. 1456 784.

A security paper protected this way, has the advantage of having an invisible design in an internal area, which becomes visible for example during the illumination with ultraviolet light.

The security means according to invention do not serve just as protection against forgeries or mechanical erasing, but guarantee also the authenticity of the check paper. This becomes apparent when one considers the total forgeries which are done with color copying machines and which are noticed with increasing frequency in check traffic. Such forgeries can easily be distinguished from the originals which have been produced according to examples 2, 3 or 4, and which have a colored picture of the written information in an internal area of the paper volume.

What is claimed is:

1. A method, for producing check paper which is resistant to tampering or forgery comprising the steps of:

producing a first web of paper pulp and producing a second web of paper pulp utilizing a double-sieve paper machine and adding micro encapsulated leuco ink and color acceptor to the paper prior to joining said webs, forming a sheet of paper from the paper material of the first and second webs of the double-sieve machine by joining said first and second webs such that the micro encapsulated leuco ink and the color acceptor are present together only in a region of interface of the two webs.

2. Method for the production of a check paper on a double-sieve machine according to claim 1, wherein the step of adding the leuco ink includes adding leuco ink between the two webs before uniting the two webs.

3. Method according to claim 2, wherein the step of adding the leuco ink includes spraying by means of jets between the webs.

4. Method according to claim 3, wherein the leuco ink is sprayed while suspended in a liquid.

5. Method according to claim 1, wherein the leuco ink is applied by means of jets in the form of designs or curved lines.

6. The method for the production of check paper according to claim 1, wherein the step of adding the color acceptor and the leuco ink comprises adding the color acceptor throughout the material of one of said webs and adding said leuco ink throughout the material of the other of said webs.

7. The method for the production of check paper according to claim 1, wherein the color acceptor is micro-encapsulated.

8. The method for the production of check paper according to claim 1, wherein the step of adding the color acceptor includes adding the color acceptor between the two webs before uniting the two webs.

9. The method for the production of check paper according to claim 8, wherein the step of adding the color acceptor includes spraying by means of jets betwen the webs.

10. The method for the production of check paper according to claim 9, wherein the color acceptor is sprayed while suspended in a liquid.

11. The method for production of check paper according to claim 10, wherein the color acceptor is applied in the form of designs or curved lines.

12. The method of claim 1 or 7, wherein either one of the leuco ink or the color acceptor is added by introducing said one throughout the material of one web on the double-sieve paper machine and the other one of the leuco ink or the color acceptor is added by applying said other one between the webs by spraying.

13. The method of claim 12, wherein said spraying step is by means of jets.

14. The method of claim 13, wherein the one of the leuco ink or the color acceptor is sprayed while suspended in a liquid.

15. The method of claim 14, wherein the spraying is in the form of designs or curved lines.

16. The method for the prodouction of check paper according to claim 1, wherein the step of adding both the color acceptor and the micro-encapsulated leuco ink includes adding said color acceptor and leuco ink between the two webs before uniting the two webs.

17. A method, for producing check paper which is resistant to tampering or forgery comprising the steps of:

adding micro-encapsulated leuco ink to paper pulp associated with one web of a double-sieve paper machine;

adding color acceptor to paper pulp associated with a second web of a double-sieve paper machine; and forming a sheet of paper from the paper pulp of the first and second webs of the double-sieve machine.

18. A method according to claim 1 including the step of forming said webs from fibrous paper pulp.

* * * * *